US005228660A

United States Patent [19]

Massicotte

[11] Patent Number: 5,228,660

[45] Date of Patent: Jul. 20, 1993

[54] POWER OPERATED CARPET STRETCHING TOOL

[76] Inventor: Léopold Massicotte, C.P. 293, Philipsburg, Quebec, J0J 1N0, Canada

[21] Appl. No.: 712,838

[22] Filed: Jun. 10, 1991

[51] Int. Cl.[5] ..... B25B 25/00

[52] U.S. Cl. ..... 254/201

[58] Field of Search ..... 254/201, 200, 228; 294/8.6

[56] References Cited

U.S. PATENT DOCUMENTS

| | | | |
|---|---|---|---|
| 3,216,702 | 11/1965 | Dahkle | 254/200 |
| 3,951,382 | 4/1976 | Asbury | 254/201 |
| 3,977,651 | 8/1976 | Chamberlain | 254/201 |
| 4,008,879 | 2/1977 | Youngman | 254/201 |
| 4,042,211 | 8/1977 | Hammond et al. | 254/201 |
| 4,084,787 | 4/1978 | Kowalczyk | 254/201 |
| 4,361,311 | 11/1982 | Koroyasu et al. | 254/200 |
| 4,394,004 | 7/1983 | Allen et al. | 254/204 |
| 4,627,553 | 12/1986 | Koroyasu | 294/8.6 |
| 4,730,858 | 3/1988 | Humann | 294/8.6 |
| 4,906,323 | 3/1990 | Thomas | 254/200 X |

FOREIGN PATENT DOCUMENTS

| | | |
|---|---|---|
| 965769 | 4/1975 | Canada . |
| 998993 | 10/1976 | Canada . |

*Primary Examiner*—Daniel P. Stodola
*Assistant Examiner*—Michael R. Mansen
*Attorney, Agent, or Firm*—Edwin E. Greigg; Ronald E. Greigg

[57] ABSTRACT

A power operated carpet stretcher comprising a frame having a bottom surface provided with prong members positioned and sized to grasp a carpet. A hook is slidably mounted on the frame to engage a slat fixed to the floor adjacent a wall edge. The hook is operatively connected to a power jack in such a manner that, upon actuation of the power jack, the frame is pulled toward the slat engaged by the hook thereby causing the carpet to be pulled by the prong members toward the adjacent wall edge. A method of installing a carpet with this stretcher is also disclosed.

15 Claims, 8 Drawing Sheets

POWER OPERATED CARPET STRETCHING TOOL

BACKGROUND OF THE INVENTION

1. Field of the invention

This invention relates to a power-operated carpet stretcher having prongs downwardly projecting therefrom to engage a carpet, and a hook slidably mounted thereon in such a manner as to engage a slat fixed to the floor adjacent a wall edge, the hook being drivable by a power jack to cause the stretcher, its prongs and the carpet to be pulled toward the wall edge when the jack is actuated.

2. Description of related art

Power-operated carpet stretchers are already known.

For instance, U.S. Pat. No. 4,361,311 dated Nov. 30, 1982 to KOROYASU et al., discloses a carpet stretcher having an electromagnetic coil installed in a body case, whereby upon energization of the electromagnetic coil, a plunger is advanced to strike the rear end of an engaging head with its front end.

U.S. Pat. No. 4,394,004, dated Jul. 19, 1983, to ALLEN et al., discloses a threadedly movable element to stretch a carpet.

U.S. Pat. No. 4,627,653 dated Dec. 9, 1986, to KOROYASU, discloses a carpet stretcher having a head with a number of prongs, a knee pad and an air cylinder. The air cylinder is used to absorb shocks and to transmit impacts made by the operator's knee to the carpet.

U.S. Pat. No. 4,730,858, dated Mar. 15,1988, TO HUMANN, discloses a manual tool for use to stretch a carpet.

Canadian patent 965,769, dated Apr. 8, 1975, granted to ROBERTS CONSOLIDATED INDUSTRIES INC., discloses a carpet stretcher including telescopic tubular members having at one end a plate wearing teeth to engage the carpet.

Canadian patent 998,993, dated Oct. 26, 1976, to ROBERTS CONSOLIDATED INDUSTRIES INC., disclosed another stretcher with a telescopic tube locking device.

SUMMARY OF THE INVENTION

Broadly stated, the invention is directed to a power operated carpet stretcher comprising a frame having a bottom surface provided with grasping prong members sized and positioned to grasp a carpet; a hook slidably mounted on the frame to engage a slat fixed to a floor adjacent a wall edge; and a power jack mounted on the frame and operatively connected to the hook in such a manner that, upon actuation of power jack, the frame is pulled toward the slat engaged by the hook, thereby causing the carpet grasped by prong members to be pulled toward the wall edge.

The invention is also broadly directed to a method to install a carpet, comprising the steps of:

providing a slat fixed to a floor adjacent a wall edge;

grasping the carpet to be installed at a given distance from said wall edge;

pulling the grasped carpet toward the wall edge using the slat as a holding means to do so; and just before pulling the grasped carpet toward the wall edge, giving a quick side motion to pull sideways any spare carpet to tighten said carpet also sideways;

whereby the carpet is tightened both lengthwisely and sidewisely.

The method may also comprise the steps of grasping the carpet at at least two different distances from the wall edge, the first distance being closer to the wall edge than the second one, in such a manner that, when the carpet is moved toward the wall edge grasping, of the carpet at said first distance is released to enable easier fastening of the carpet along the wall edge.

BRIEF DESCRIPTION OF THE DRAWINGS

In the drawings which illustrate a preferred embodiment of the invention.

DESCRIPTION OF A PREFERRED EMBODIMENT

The power-operated carpet stretcher (10) according to the invention as shown in the accompanying drawing is hydraulically operated. It basically comprises a frame (12) provided with grasping nail members or prongs **(12*a*), (12*b*). projecting from its bottom surface, the prongs being sized and positioned to engage and grasp a carpet (15) as is better shown in FIG. 2**.

Figure 1:
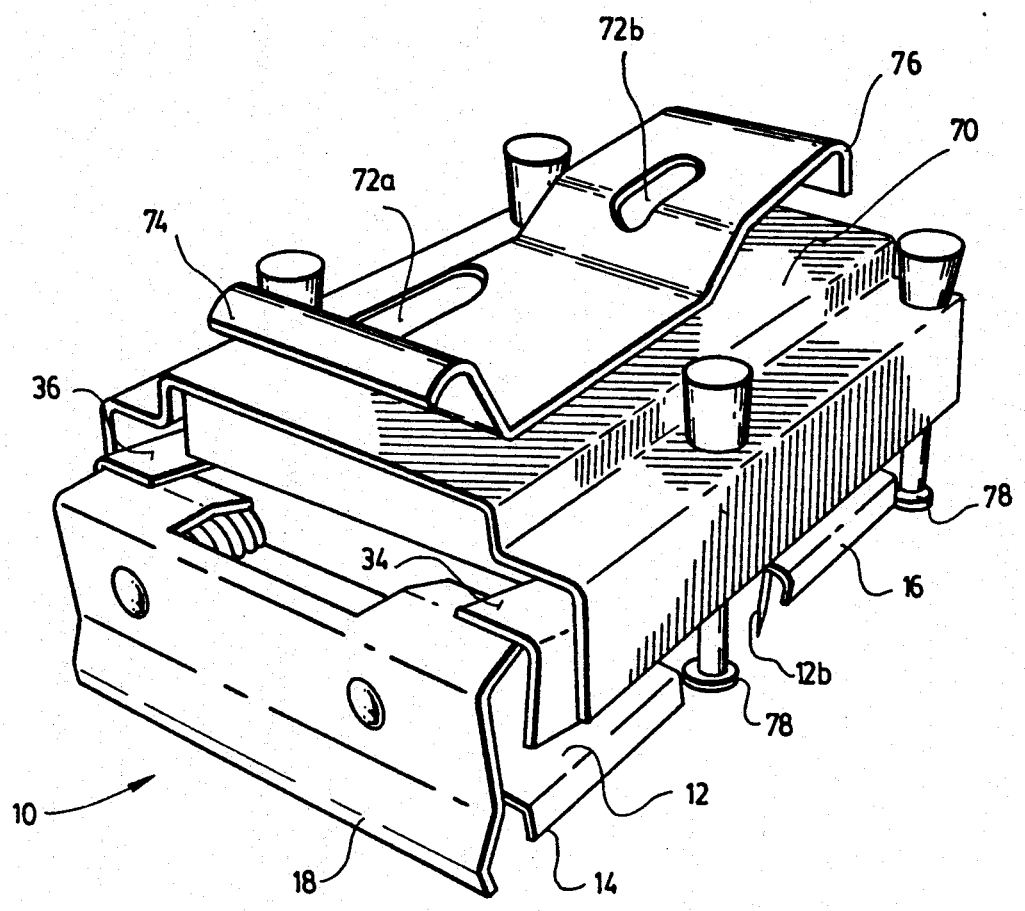
FIG. 1 is a perspective view of a hydraulic carpet stretcher.

The grasping nail members or prongs preferably form two bands (14) and (16) as shown in FIG. 1. The nail members are slightly inclined toward a hook (18). The hook is positioned to engage a slat (20) that is fixed, usually with nails, to the floor adjacent a wall edge of the room in which the carpet is to be installed. The hook (18) is operatively connected to a hydraulic jack (22), whereby upon actuation of the jack, the frame (12) is pulled toward the slat (20) engaged by the hook (18). thereby causing the carpet engaged by the nail members or prongs to be pulled toward the wall edge. The hook (18) is such as to engage one side of the slat only, thereby leaving exposed the top of this slat to enable proper fixation of the carpet edge. To this end, the top edge of the slat may be provided with upwardly projecting prongs as is known per se in this field.

As shown in FIGS. 2 to 5, the hydraulic jack (22) of the carpet stretcher is asymmetrically mounted on a carriage (24) freely mounted onto the frame (12) to give a side movement to this frame when the hydraulic jack is actuated to move the frame (12) toward the hook (18). It should be noted that although a hydraulic jack is preferred, other power jacks could be used, including endless-screws driven by motors such as electrical motors. In fact, any other means capable to develop the necessary power, may be used.

Figure 5:
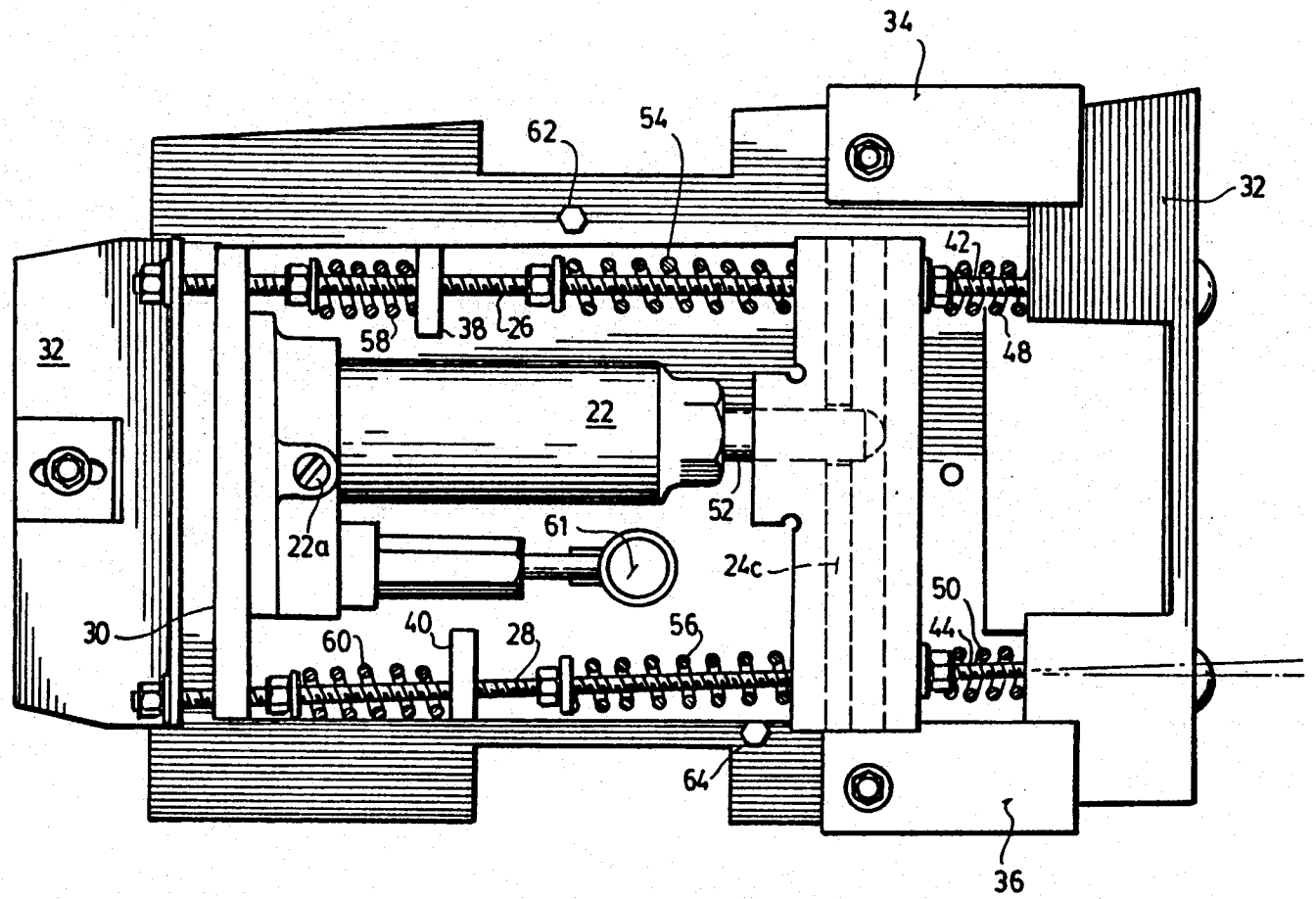
FIG. 5 is a top plan view of the stretcher of FIG. 2.

The carriage (24) is slidably mounted on a pair of guiding rods (26), (28) (FIG. 5). The guiding rods are secured to the frame (12) by means of a pair of brackets (30), (32).

Figure 2:
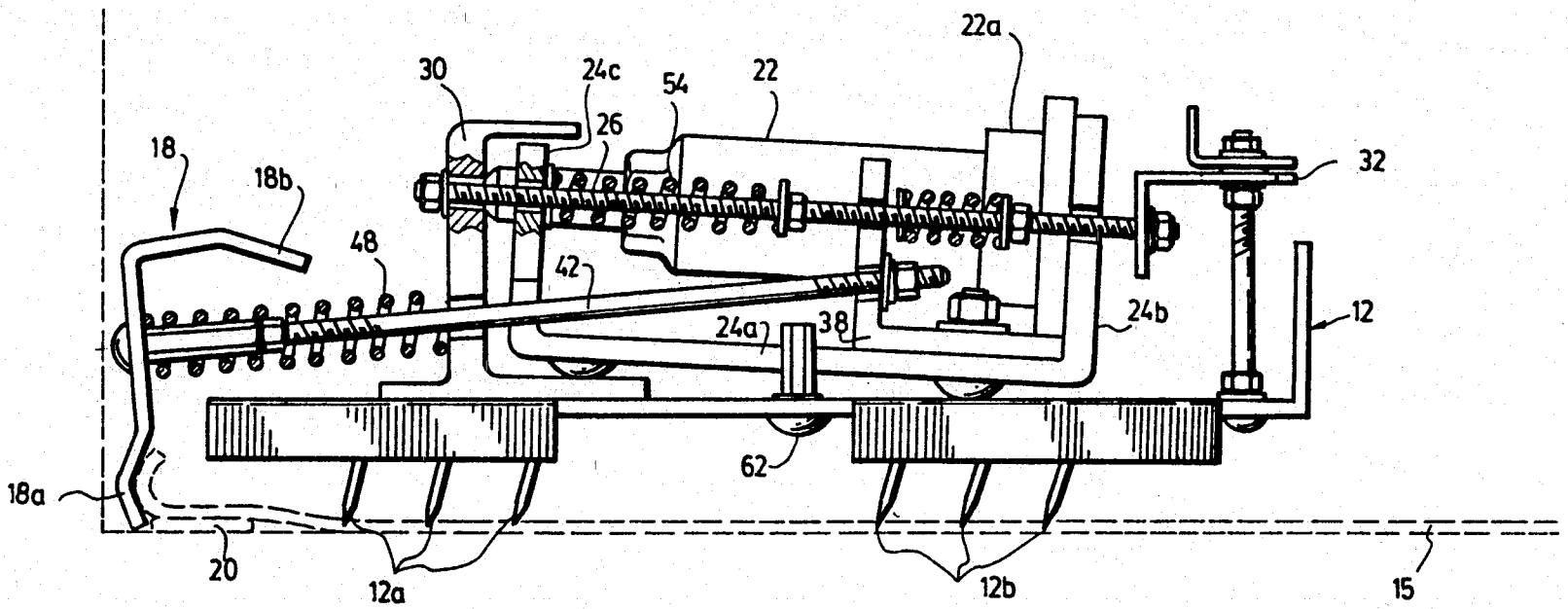
FIG. 2 is a side elevational view partly in cross-section of the hydraulic carpet stretcher of FIG. 1, at rest, with the cover removed.
Figure 3:
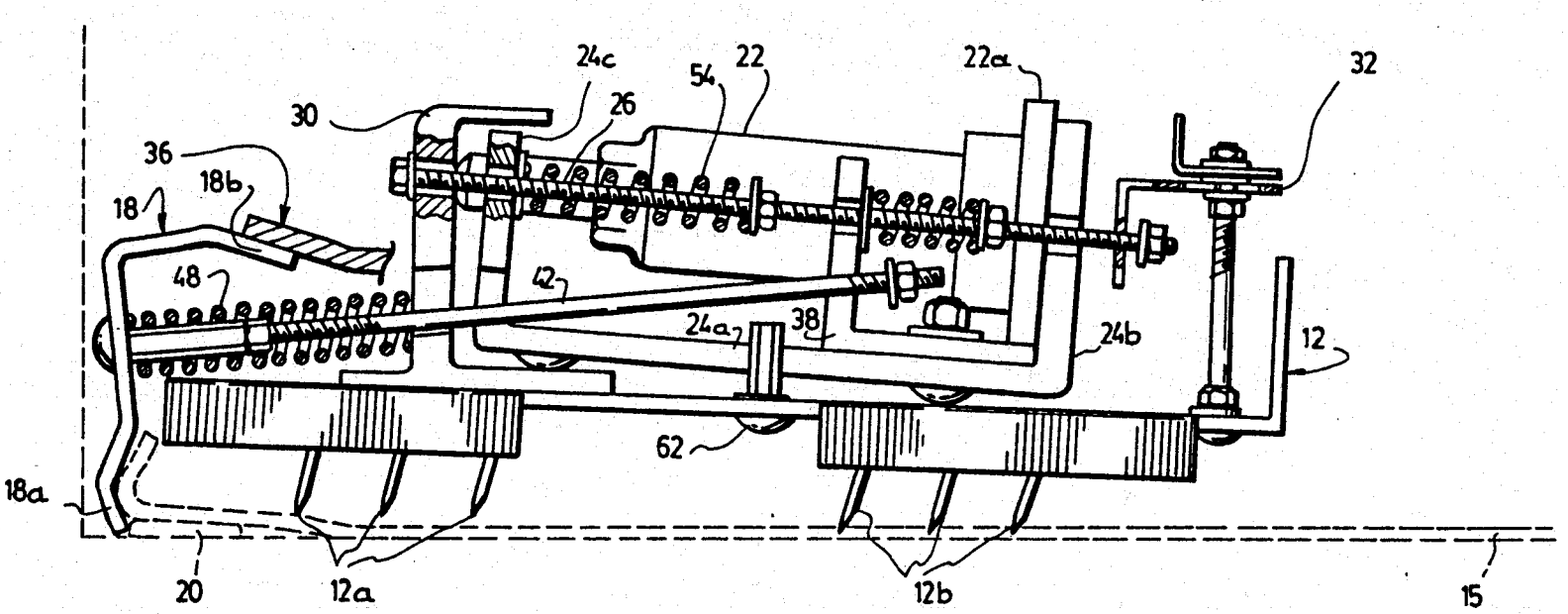
FIG. 3 is a side elevational view partly in cross-section of the hydraulic carpet stretcher of FIG. 2, showing a first motion.
Figure 4:
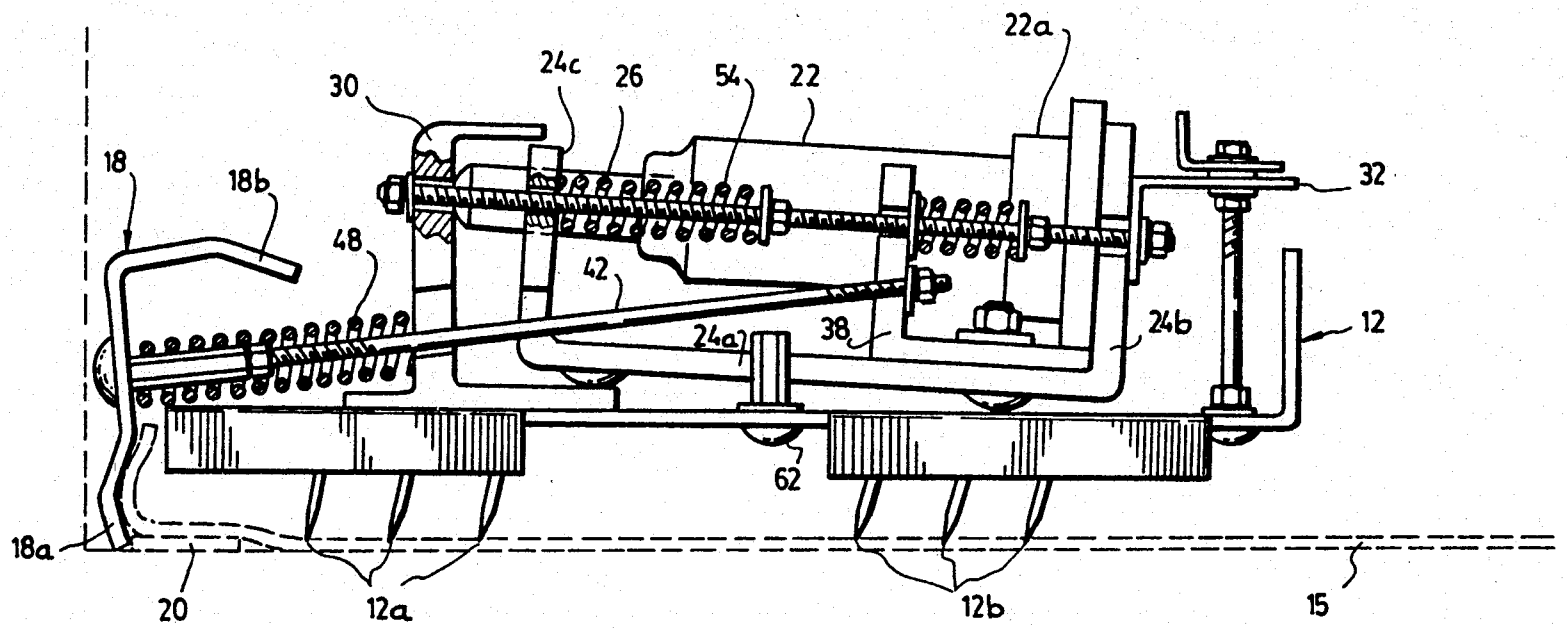
FIG. 4 is another side elevational view partly in cross-section of the hydraulic carpet stretcher of FIG. 2, showing a second motion.

Preferably, the hook (18) has an inverted L shape, the lower portion of it being curved outwardly, as shown at (18*a*) in FIG. 2 to 4, to ease its engagement with the slat (20) and to ease fixation of the carpet onto this slat (20). Preferably also, the upper edge of the inverted L-shaped hook is slightly inclined inwardly downwardly, as shown at (18*b*), to provide a cave surface.

The frame preferably has a pair of L-shaped side members (34) and (36) positioned to engage and slide above the upper edge of the inverted L-shaped hook (18*b*) when the frame is being pulled and thus allow gradual release of the grasping prong members (12*a*). As the frame (12) moves toward the hook (18). the upper edge of the inverted L-shaped hook moves under the pair of L-shaped side members (34), (36). Preferably, these side members are adjustably mounted on the frame (12) and more preferably are spring loaded so as to resiliently urge this pair of L-shaped side members (34), (36) against the top of the upper edge of the inverted L-shaped hook (18*b*). In this manner, one may obtain displacement of the frame very close to the hook, while the frame is moved upwardly away from the floor, as it is displaced toward the hook.

The carriage (24) is preferably U-shaped, with a bottom wall (24*a*) and a pair of upper opposite walls (24*b*) and (24*c*), respectively. The hydraulic jack (22) has its foot (22*a*) asymmetrically mounted, on one of opposite walls (24*b*) of the carriage, and extends between the pair of guiding rods (26), (28) supporting this carriage. The upper portions (24*c*) of the upper opposite walls of the U-shaped carriage are slidably engaged by the guiding rods (26), (28). The U-shaped carriage also has on each side a L-shaped bracket (38), (40) secured to its bottom wall. Each bracket (38) (40) defines a passage allowing sliding and guidance of the componding rod (26), (28). Tie-rods (42), (44) extend between the brackets (38) (40) and the hook (18). The tie-rods (42), (44) passes through the bracket (30) secured to the frame (12). Compression springs (48), (50) are mounted on the portions of the tie-rods (42), (44) extending between the bracket (30) and the hook (18) to urge outwardly the frame when the jack is at rest, i.e. when it has no air or fluid fed therein. Thereby, the hook is urged away from the support by the springs. The biasing action of said springs is overcome when fluid under pressure is fed in said hydraulic jack.

On each side of the L brackets secured to the bottom wall of the U-shaped carriage, the guiding rods (261), (28) further comprise means to counterbalance the pressure exerted by the cylinder, to overcome inertia and to enable easy disengagement of the prong members from the carpet when the pressure in the hydraulic jack is released. This can conveniently be attained by a pair of springs, mounted on the rods as will be discussed hereinbelow.

The piston stem (52) of the hydraulic jack (22) (better shown in FIG. 5) is displaceable and slidable through an opening in the upper opposite wall of the carriage (24*c*). It presses against the wall (30) fixed on said frame (12). Thus, upon actuation of the jack the U-shaped carriage containing said jack is moved away from the bracket (30) fixed to the support (12), thereby bringing the frame (12) closer (12) to the hook (18).

Advantageously, the rods (26), (28) are spring loaded to urge the U-shaped carriage in an unengaged position. For this purpose, a first set of compression springs (54), (56) is provided, which are slidably mounted on the rods and have one end bearing against the inner portion of the wall (24*c*) and another end bearing against nuts curved onto the rods (26), (28).

A second set of compression springs (58), (60) is also provided, having ends bearing against L-shaped brackets (38), (40) secured on the bottom wall of the U-shaped carriage and other ends bearing against other nuts secured onto the rods (26), (28). When the jack is deactuated, this second set of springs overcomes the inertia of this hydraulic jack.

Advantageously, the carpet stretcher is provided on each side with at least one guiding post such as (62), (64) to confine the motion of the carriage within certain limits. The guiding rods (26), (28) are mounted to the frame (12) as shown at (32) to allow a swivel motion of these rods and thereby of the carriage up and down and to and fro the frame.

In a most preferred embodiment, the rods (26) and (28) are not parallel, but slightly converging toward the hook (18). Also, the springs (54), (58) and (56) and (60) are asymmetrically loaded.

Figure 7:
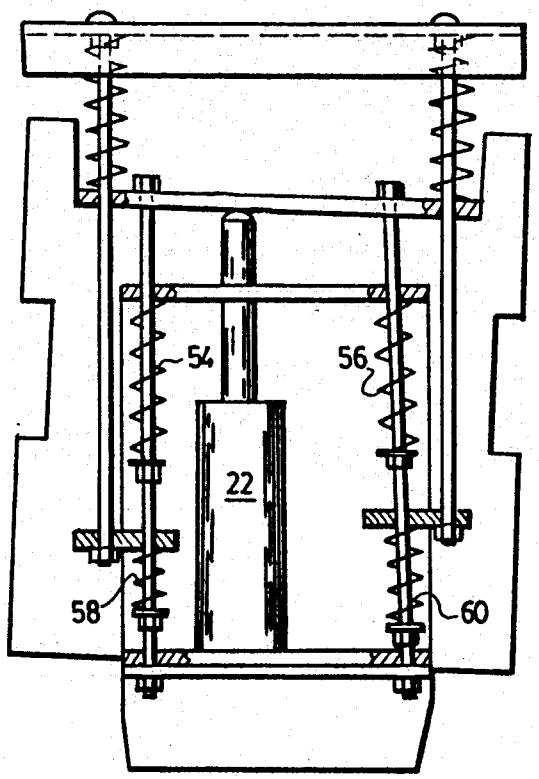
FIG. 7 is a top plan view which illustrates the spring arrangement and piston of FIG. 3.
Figure 6:
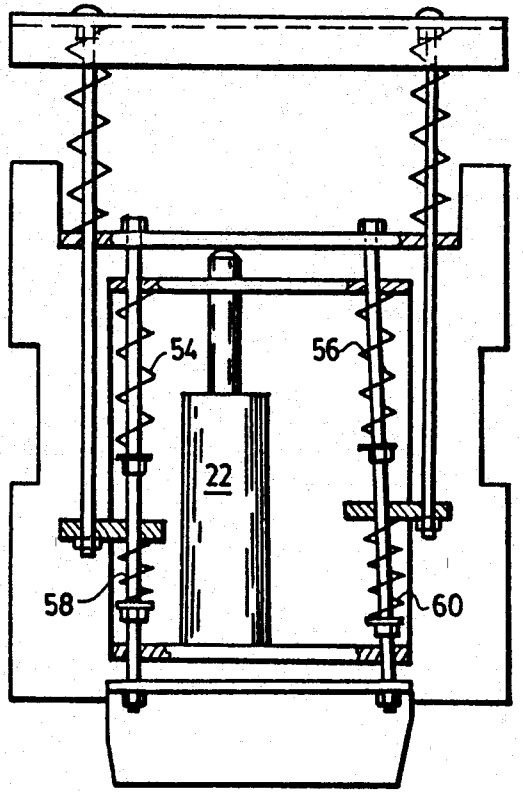
FIG. 6 is a top plan view which illustrates the spring arrangement and piston of FIG. 2.
Figure 8:
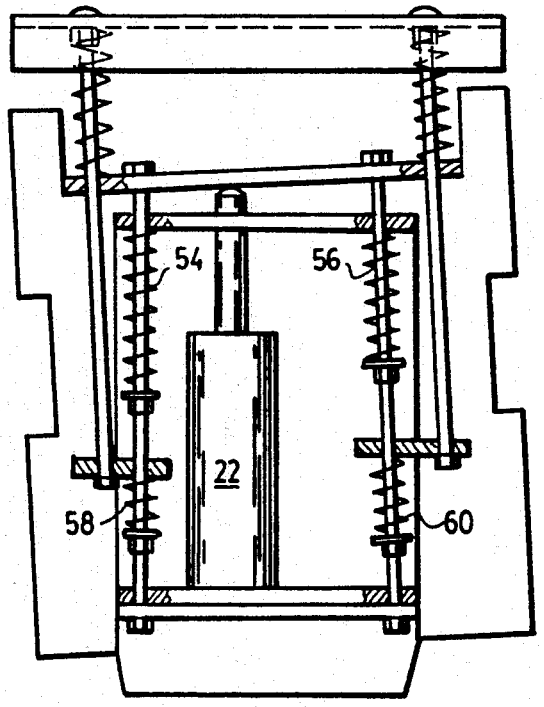
FIG. 8 is a top plan view which illustrates the spring arrangement and piston of FIG. 4.
Figure 9:
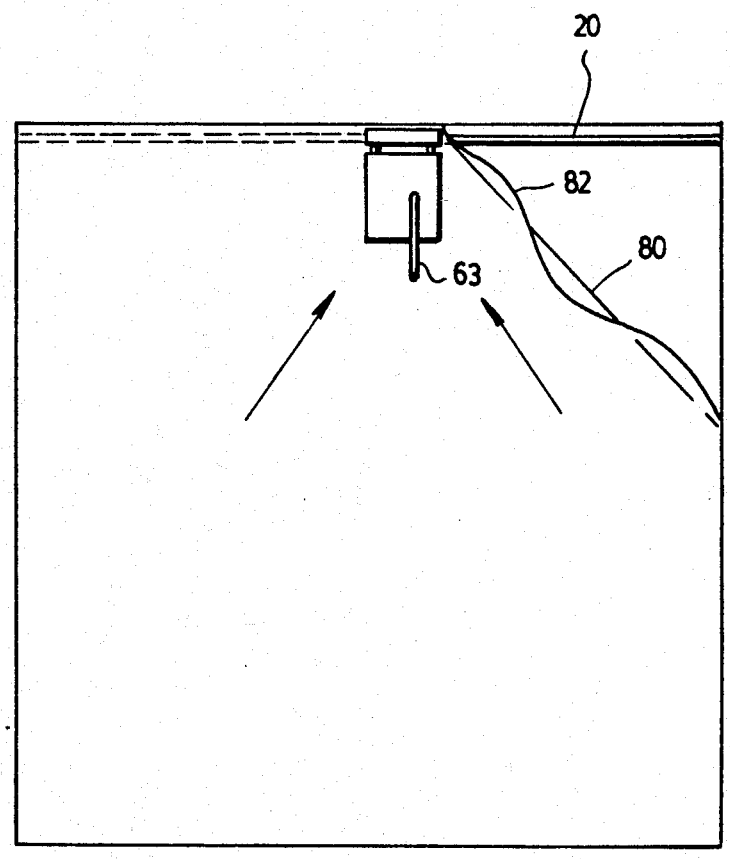
FIG. 9 is a top plan view of a room, which illustrates the path followed by the carpet stretcher of FIG. 1 on use.

As shown with particular references to FIGS. 6, 7 and 8, three difference forces cooperate when the stretcher is actuated because:

1) the piston (22) is asymmetrically mounted;
2) the rod (28) makes an angle of 3°–6° with the longitudinal axis; of the frame;
3) the springs numbered (56) and (58) or the rod that makes an angle, preferably are precompressed and thus exert a greater pressure than (54) and (60), thereby displacing the support (12) with the grasping nail members or prongs to the right as shown at (80) in FIG. 9 and in FIG. 7. Then the motion is reverse to the left as shown at (82) in FIG. 8. This carpet stretcher enables two-dimensional stretching.

As an example, the springs may have the following characteristics:

| | Springs number | | | |
|---|---|---|---|---|
| | 54 | 56 | 58 | 60 |
| Number of coils | 15 | 16 | 16 | 7.5 |
| Defining an axial length in inch of: | 3.450 | 3.000 | 3.590 | 1.650 |
| Each coil has an outside diameter of | .975 | .488 | .690 | .615 |
| For a pitch of (in inches) | .275 | .215 | .235–.255 | .250 |
| Wire gauge (diameter in inches) | .116 | .054 | .116 | .105 |

The jack may conveniently be actuated by a releasable telescopic or non telescopic handle (such a tubular handle schematically shown at 63 in FIG. 9), engageable in a socket (61) (FIG. 5). The jack is conveniently provided with a pressure-release outlet (22*a*). This outlet can also be actuated with a telescopic handle by the other end of the handle, defining a corresponding engagement.

Preferably, the handle is removably mounted.

The carpet stretcher is conveniently provided with a cover to house the jack and the carriage, as shown at (70) in FIG. 1. The cover may have an opening (72*a*)

and (72*b*) to receive the handle and allow its connection into the socket (62). The cover may also be provided with a pair of handles (74), (76). The carpet stretcher may also be conveniently provided with pairs of threadedly mounted adjustable legs (78) in order to space the prong members properly on the carpet.

As one can easily see, the invention can be used to install a carpet. In a first step, a slat (20) in nailed to the floor adjacent a wall edge. Then, using the above described stretcher, the carpet may be grasped and pulled toward the wall edge, using the slat as a holding means or support for the pull. Just before pulling the carpet toward the wall edge, a quick side motion is given by the stretcher thanks to its structure, which pulls sideways any spare carpet and tighten this carpet sideways.

By grasping the carpet at two different distances from the wall edge with the prongs (12*a*) and (12*b*), respectively and allowing release of the prongs (12*a*) from the carpet when the same reaches the wall edge, easier fastening of this carpet along said wall edge in achieved.

Although the present invention has been explained hereinabove by way of preferred embodiments thereof, it should be pointed out that any modifications to these preferred embodiments, within the scope of the appended claims, is not deemed to change or alter the nature and scope of the invention.

What is claimed is:

1. A power operated carpet stretcher comprising:

a frame having a bottom surface provided with grasping prong members sized and positioned to grasp a carpet;

a hook slidably mounted on said frame to engage a slat fixed to a floor adjacent a wall edge; and a hydraulic jack asymmetrically mounted on a carriage, that is slidably mounted on a pair of guiding rods secured to said frame, said carriage being operatively linked to said hook, so as to obtain first a side movement of said frame when the hydraulic jack is actuated to move said frame toward said hook, and the frame is pulled toward the slat engaged by said hook thereby causing said carpet grasped by said grasping prong members to be pulled toward said wall edge, said carriage is U-shaped and has a bottom wall and opposite upper end walls;

said hydraulic jack asymmetrically mounted in said carriage has one foot bearing against one of said opposite upper end wall and extends between said pair of guiding rods, with said opposite upper end walls slidably engaging said rods;

said U-shaped carriage also comprises on each side an L-shaped bracket secured to the bottom wall of said U-shaped carriage, each of said L-shaped brackets defining a passage to allow sliding and guidance of said guiding rods therein;

said L-shaped brackets are connected to said hook by means of tie-rods;

each of said guiding rods comprises on each side of the corresponding L-shaped bracket, means to counterbalance the pressure exerted by said hydraulic jack, to overcome inertia and to enable easy disengagement of the prong members from the carpet when the pressure in the hydraulic jack is released;

said frame is further provided with at least one upper wall extending parallel to said opposite upper end wall between the other of said opposite upper end walls and said hook;

said hydraulic jack has a piston rod opposite said foot and said other opposite upper end wall has an opening in space relation to said hydraulic jack to let pass said piston stem, said piston stem being displaceable through said opening and pressing against said upper wall of said frame;

where upon actuation of said hydraulic jack, said U-shaped carriage containing said hydraulic jack is moved away from said upper wall of said frame and bring said frame closer to said hook.

2. A carpet stretcher as defined in claim 1, wherein said guiding rods are provided with means to permanently urge said U-shaped carriage back into an unengaged position.

3. A carpet stretcher as defined in claim 2, wherein each of said guiding rods are provided with a pair of compression springs slidably mounted thereon, one of said springs extending against said other opposite upper end wall of said carriage having said opening, and a first nut, the other spring bearing against the corresponding L-shaped bracket secured to said U-shaped carriage and a second nut, whereby said other spring overcomes inertia when the hydraulic jack is deactivated.

4. A carpet stretcher as defined in claim 3, wherein:

said frame has a longitudinal axis;

one of said guiding rods makes an angle with respect to said longitudinal axis; and the springs on said angularly oriented guiding rod are precompressed to exert a greater compression than on the other springs on the other guiding rod to cause displacement of said frame having the grasping prong members to one side and then reversal of the motion to the other side, thereby enabling two-dimensional stretching.

5. A carpet stretcher as defined in claim 4, wherein said angle is of 3° to 6°.

6. A carpet stretcher as defined in claim 1, wherein said frame is provided on each side with at least one guiding post to confine the motion of the carriage within said frame.

7. A carpet stretcher as defined in claim 1, wherein said guiding rods are pivotably mounted onto said frame.

8. A carpet stretcher as defined in claim 1, further comprising:

a cover to house said power jack and said carriage, said cover having an opening to receive a telescopic handle to actuate said power jack.

9. A carpet stretcher as defined in claim 1, wherein said hook is urged away from said frame by biasing means, said biasing means being overcome by said power jack when said power jack is actuated.

10. A power operated carpet stretcher comprising:

a frame having a bottom surface provided with grasping prong members sized and positioned to grasp a carpet;

a hook slidably mounted on said frame to engage a slat fixed to a floor adjacent a wall edge; said hook has an inverted L-shaped section relative to the floor and a lower portion curved outwardly to ease engagement with said slat, said inverted L-shaped hook has an upper edge that is slightly inclined inwardly downwardly to provide a concave surface, and said frame is provided with a pair of L-shaped side members positioned to engage and slide above said upper edge of said inverted L-shaped hook and thereby enable the grasping prong members to be gradually released as the frame moves toward said hook, as inverted L-shaped hook moves under said pair of L-shaped side members, and a power jack mounted on the frame and operatively connected to said hook in such a manner that upon actuation of said power jack, the frame is pulled toward the slat engaged by said hook thereby causing said carpet grasped by said grasping prong members to be pulled toward said wall edge.

11. A carpet stretcher as defined in claim 10, further comprising:

means to move a front end of said frame upwardly relative to the floor as said frame is displaced toward said hook.

12. A carpet stretcher as defined in claim 10, further comprising:

means to give a side movement to the frame as said frame starts moving toward said hook.

13. A carpet stretcher as defined in claim 10, further comprising:

adjusting means to adjust the spacing between said grasping prongs.

14. A carpet stretcher as defined in claim 10, wherein said pair of L-shaped members are adjustable to allow adjustment of the gradual release of the prong members.

15. A carpet stretcher as defined in claim 10, wherein said power jack is actuatable with a releasable telescopic handle and is provided with release outlet.

* * * * *